United States Patent [19]

Rice, Jr.

[11] Patent Number: 4,696,666

[45] Date of Patent: Sep. 29, 1987

[54] CENTRIFUGE MACHINE AND ROTOR

[76] Inventor: Richard D. Rice, Jr., 3030 S. Xeric Ct., Denver, Colo. 80231

[21] Appl. No.: 886,913

[22] Filed: Jul. 18, 1986

[51] Int. Cl.[4] ..... B04B 5/02

[52] U.S. Cl. ..... 494/16; 494/67

[58] Field of Search ..... 494/16, 17, 18, 19, 494/20, 21, 85, 67; 422/72; 210/360.1, 781, 782, 927

[56] References Cited

U.S. PATENT DOCUMENTS

| | | | |
|---|---|---|---|
| D. 193,341 | 3/1962 | Fuller | D16/2 |
| D. 193,981 | 4/1962 | Ames et al. | D16/2 |
| D. 231,924 | 8/1974 | Pollard . | |
| D. 231,981 | 3/1974 | Paulsen . | |
| D. 259,140 | 2/1981 | Pross et al. . | |
| 2,699,289 | 8/1955 | Allen et al. | 233/26 |
| 2,878,992 | 6/1959 | Pickels et al. | 233/11 |
| 2,883,103 | 2/1959 | Whitehead et al. | 233/27 |
| 2,885,145 | 7/1959 | Danielsson et al. | 233/26 |
| 3,009,388 | 7/1961 | Polanyi | 88/14 |
| 3,050,239 | 10/1962 | Williams | 233/24 |
| 3,199,775 | 12/1965 | Drucker | 233/25 |
| 4,484,906 | 11/1984 | Strain | 494/16 |
| 4,604,086 | 8/1986 | Benko | 494/16 |

OTHER PUBLICATIONS

Misc Catalog Sheets (Clay-Adams, Aloe Scientific, Curtin Matheson Scientific and VWR Scientific.

*Primary Examiner*—Robert W. Jenkins

*Attorney, Agent, or Firm*—Norvell E. Von Behren

[57] ABSTRACT

A centrifuge rotor and apparatus for the determination of whole blood micro-hemotocrits for in vitro diagnostic use. The centrifuge rotor comprises a base with at least two inner tube retainers and at least two outer tube retainers. An elongated hole is provided in both of the tube retainers for securely positioning a tube containing blood onto the centrifuge rotor. As the centrifuge rotor is subjected ot rotary action, the tubes are held in place by centrifugal force in conjunction with the inner and outer tube retainers and neither central lateral support for the tubes nor a separate cover is required for use of the rotor or apparatus.

18 Claims, 11 Drawing Figures

PRIOR
ART

CENTRIFUGE MACHINE AND ROTOR

BACKGROUND OF THE INVENTION

This invention relates generally to a centrifuge machine and more particularly to a new, novel and easy to manufacture centrifuge rotor which does not require a separate cover to hold blood tubes in place and further does not require the central lateral support of the blood tube, known in the trade as micro hematocrit capillary tubes.

When a blood test is taken for various reasons, typically, the finger of the patient is pricked and a small amount of blood is collected in a thin blood tube. At this point, after being sealed with clay, the blood tube is positioned in a centrifuge rotor and rotated at high speeds, causing the red blood cells to be separated from the blood plasma as the rotary action serves to move the red blood cells to the outside of the tube and the blood plasma is moved to the inside of the tube.

Typical hematocrit centrifuge machines are produced by Damon/IEL and Clay Adams, a division of Becton Dickenson. The typical centrifuge rotor head and cover is provided in a circular configuration with numerous supports for the blood tubes extending from the center of the circular configuration in a manner similar to the spokes of a wheel. The supports for the blood tubes provide central lateral support for the blood tube by providing a groove into which the blood tube is placed. A separate circular cover is then screwed in place over the centrifuge head to insure that the blood tubes are not dislodged when the centrifuge rotor is rotated.

Applicant's new and novel centrifuge rotor is provided in the form of a plate having two retainer means for each blood tube, both of the retainer means having positioned therein an elongated hole for securely holding the tube in place. In this manner, the blood tube is held securely in position by simply inserting one end of the blood tube in inner retainer means and inserting the other end of the blood tube in the outer retainer means. The new and novel centrifuge rotor does not require central lateral support nor does it require a separate cover to be positioned over the centrifuge rotor as the centrifugal force retains the tubes in place.

U.S. Pat. No. 2,699,289 to Allen et al, discloses a high-speed centrifuge having a rotatable vertical spindle wherein test tubes or the like are inserted in the device in a vertical direction to provide a balance for the loaded rotor.

U.S. Pat. No. 2,883,103 to Whitehead et al, discloses a centrifuge apparatus and method, the centrifuge vessel being in a bowl configuration with an annular trough so that the trough contains the red blood cells and the bowl portion contains the plasma.

U.S. Pat. No. 2,878,992 to Pickels et al, teaches a centrifuge apparatus and a rotor to be used on the centrifuge apparatus that is provided with a cooling fin assembly for circulating outside air down through the cover and the rotor opening.

U.S. Pat. No. 2,885,145 to Danielsson et al, discloses a centrifuge and a head for the centrifuge, the head accommodating a flexible sample tube in a spiral configuration.

U.S. Pat. No. 3,009,388 to Polanyi teaches an apparatus for determining fluid fractions and sedimentation rates which centrifuges the blood specimens while intermittently directing radiant energy through a selected portion of the blood specimen.

U.S. Pat. No. 3,050,239 to Williams, Jr., discloses a centrifuge apparatus which uses a plurality of elongated rectilinear slots as tube supports.

U.S. Pat. No. 3,199,775 to Drucker, discloses a centrifuge and a method for determining sedimentation rates which uses a rotor and a secondary rotor and an elongated container for the material to be centrifuged, which is positioned on the secondary rotor.

Design U.S. Pat. Nos. 193,341; 193,981; 231,924; 231,981; and 259,140 have been cited to illustrate various centrifuge and rotor designs.

SUMMARY OF THE INVENTION

In order to overcome problems inherent in the before-mentioned devices, there has been provided by the applicant's invention a new and novel centrifuge rotor for the determination of whole blood micro-hematocrits for in vitro diagnostic use. The centrifuge rotor has a tube retainer means which holds one end of the tube and a second tube retainer means which holds the other end of the tube. An elongated hole is positioned in both of the tube retainer means for securely positioning the tube in place. In this manner, the tube is secured in position simply by positioning the tube first in the inner retainer means and then backing it into the second tube retainer means, with the elongated holes serving to hold the tube securely in place. With applicant's new and novel centrifuge rotor, the use of a cover, as required in the prior art, is not required in the present invention. In cases where the cover has been tightened quickly or incorrectly, as the centrifuge is rotated, the cover can fly off, thus presenting a danger to medical personnel and to equipment. Also, with only two retainer means required to support each tube, central lateral support for the tube is not required, thus making it quicker and easier to insert the tube into the centrifuge rotor.

Accordingly, it is an object and advantage of the invention to provide a centrifuge rotor for use in the determination of whole blood micro-hematocrits for in vitro diagnostic use that may be used without an additional cover.

Another object and advantage of the invention is to provide a centrifuge rotor wherein tubes may be quickly and easily inserted and removed after centrifuging.

Yet another object and advantage of the invention is to provide a centrifuge rotor which can be used more safely without a cover that can potentially fly off and injure medical personnel or equipment.

Yet another object and advantage of the invention is to provide a new and novel centrifuge rotor with ease and simplicity of machining which provides for inherently better balance when spinning at speeds of 8,000 RPM or greater.

Still yet another object and advantage of the present invention is to provide a centrifuge apparatus wherein the tube cannot become dislodged when the machine is spinning.

Still yet another object and advantage of the present centrifuge rotor is to provide a rotor which can be configured in a one-piece molded plastic unit which can be disposable and more economical to use.

These and other objects and advantages of the invention will become apparent from a review of the drawings showing the invention and from a reading of the description of the preferred embodiment which has been given by way of illustration only.

DESCRIPTION OF THE PREFERRED EMBODIMENT

Figure 1:
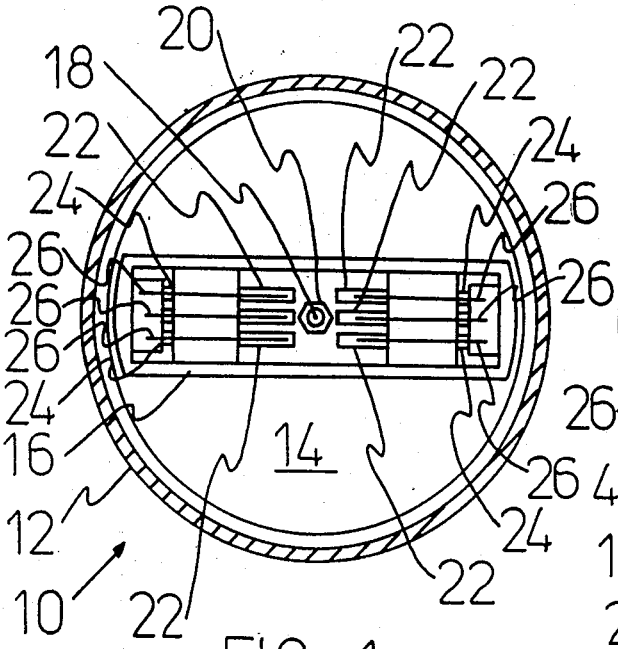
FIG -1 PRIOR ART
FIG. 1 is a top plan view of one form of the prior art.

Referring now to the drawings in general, and in particular to FIG. 1 of the drawings, there is shown a top plan view of a prior art centrifuge device shown generally by the numeral 10 as it is positioned on an existing centrifuge case 12. The centrifuge rotor 16 comprises a flat plate 14 which is most often constructed of metal which carries the rotor 16. The rotor 16 has an inner tube slot 22 and an outer tube slot 24 for holding the tubes 26. The flat plate 14 is secured to the existing centrifuge motor by means of a central shaft 18 used with a nut 20.

Figure 1A:
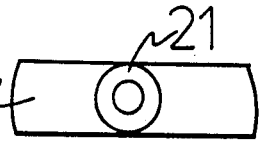
FIG. 1A is a top plan view of a cover which is required for the prior art of FIG. 1.

Referring now to FIG. 1A, there is shown a cover 19 which is required to be used with the prior art centrifuge rotor of FIG. 1. The cover 19 has a tightening nut 21 for securing the cover 19 onto the tube holder 16 of FIG. 1 by shaft 18.

Figure 2:
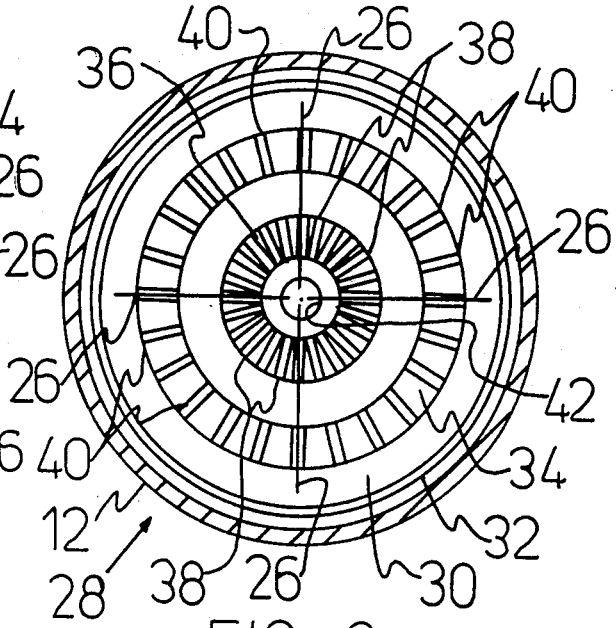
FIG -2 PRIOR ART
FIG. 2 is a top plan view of another form of prior art.

FIG. 2 is a top plan view of another prior art device, shown generally by the numeral 28, having a two-piece aluminum tube holder 30. The two-piece aluminum tube holder 30 has an outer rim 32, an outer flat circular ridge 34 and an inner flat circular ridge 36. Positioned on the two-piece aluminum tube holder 30 are inner radial tube slots 38 and outer radial tube slot 40. The two-piece aluminum tube holder 30 is also provided with attachment means 42 for attaching the two-piece aluminum tube holder 30 to the existing centrifuge case 12.

Figure 2A:
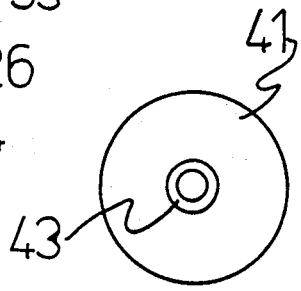
FIG-2A PRIOR ART
FIG. 2A is a top plan view of a cover which is required for the prior art of FIG. 2.

In FIG. 2A, there is shown a top plan view of a circular cover 41, which is required to be used with the prior art device 28 of FIG. 2. The circular cover 41 of FIG. 2A is provided with a tightening nut 43 for attaching the circular cover 41 to the two-piece aluminum tube holder 30 in FIG. 2. In FIG. 2, the tubes 26 are positioned in the inner slots 38 and outer slots 40 nd are held in place by the cover 41.

Figure 3:
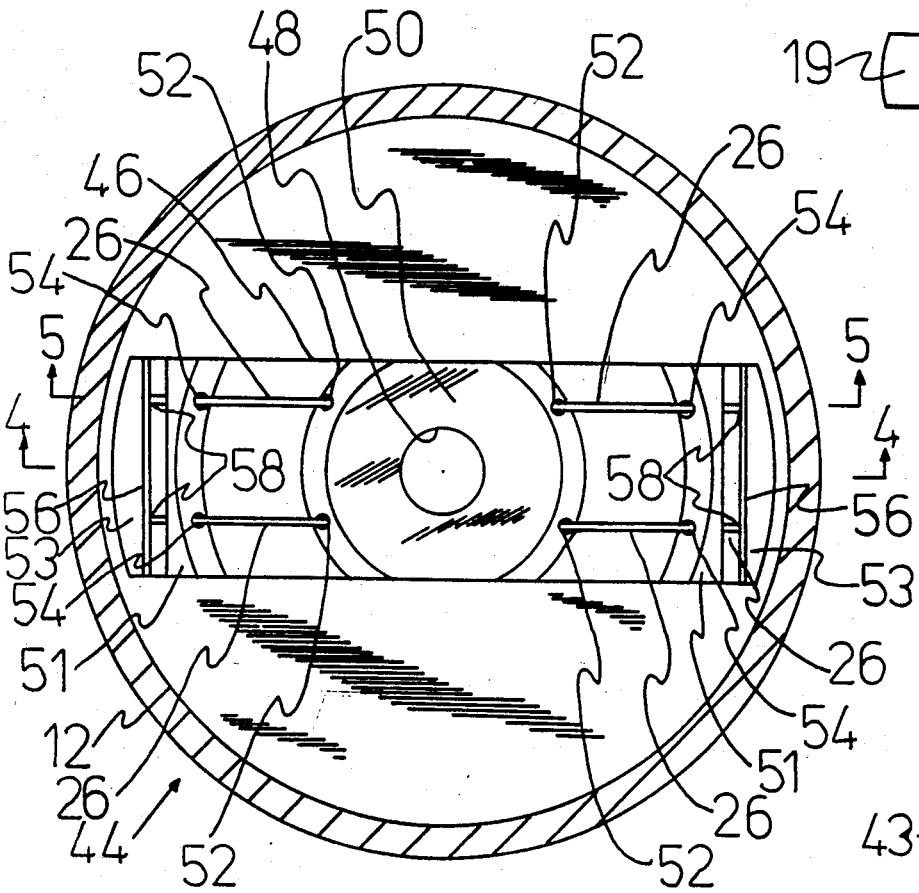
FIG. 3 is an enlarged top plan view of applicant's new and novel centrifuge rotor.

Referring now to FIG. 3, there is shown an enlarged top plan view of applicant's centrifuge device, shown generally by the numeral 44. Applicant's centrifuge device 44 comprises a one-piece plastic or aluminum rotor 46 containing an inner retainer means 52 and an outer retainer means 54 for retaining the tube 26. The one piece plastic or aluminum rotor tube holder 46 has a raised inner surface 50, a raised central surface 51 and a raised outer surface 53. There is provided a central hole 48 for attaching the one-piece plastic or aluminum rotor 46 to an existing centrifuge motor. There is a rubber cushion 56 positioned at the end 58 of the tubes 26. In application, blood is drawn from a patient into the blood tube and clay or sealer is tapped on the end of the tube. The rubber cushion 56 in FIG. 3 is used to keep the clay in the end 58 of the tube 26 from being thrown out by centrifugal force.

Figure 4:
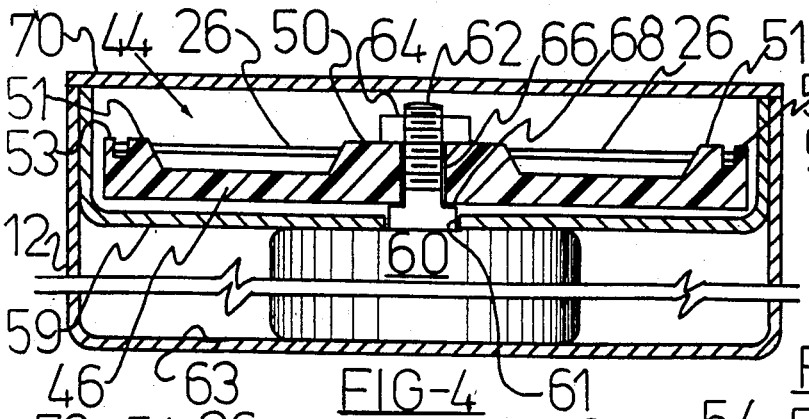
FIG. 4 is a cross-sectional view, taken through line 4—4 of FIG. 3, showing how the blood tube is positioned in the two retainer means.

In FIG. 4, there is shown a cross-sectional view, taken through line 4—4 of FIG. 3, showing how applicant's centrifuge rotor 46 is positioned in a centrifuge apparatus. In FIG. 4, inner divider 59 is attached within the existing centrifuge case 12 by known attaching means such as bolts, screws, press fit or other means. The motor 60 is mounted by known means to the bottom 63 of the existing centrifuge case 12. The shaft 62 of the motor 60 extends through a hole 61 in the inner divider 59. The motor shaft 62 is provided with threads and nut 64 or an adapter to attach applicant's centrifuge rotor 46 to an existing centrifuge motor. A hole 66 in the tube rotor 46 is provided to position the rotor on the shaft 62. Also shown in FIG. 4 is an outer safety lid 70 which can be used with applicant's centrifuge rotor 46 to prevent accidental injuries to the hands of the operator while the rotor 46 is spinning.

Figure 5:
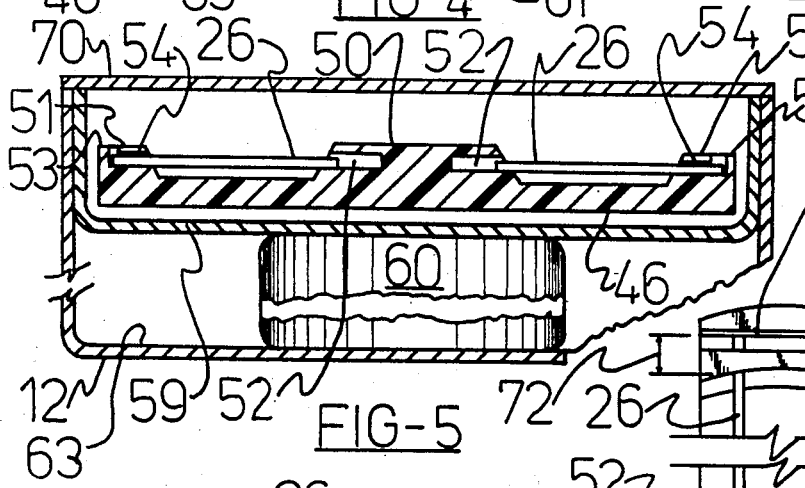
FIG. 5 is a cross-sectional view, taken through line 5—5 of FIG. 3 showing in greater detail the elongated hole in one of the retainer means.

Referring now to FIG. 5, there is shown a cross-sectional view, taken through line 5—5 of FIG. 3, showing in greater detail how the tube 26 is positioned in the inner retainer means 52 and the outer retainer means 54. Inner retainer means 52 is provided with an elongated hole to securely position the tube 26 in place so that it is not dislodged from centrifugal force as the machine is spinning.

Figure 6:
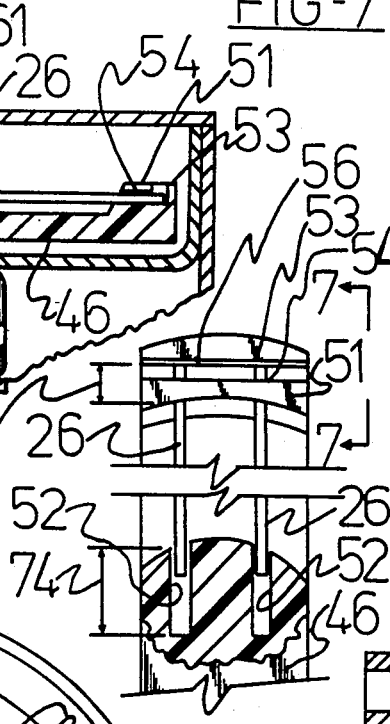
FIG. 6 is an enlarged plan view, partially broken away in section showing one side of the centrifuge rotor.

In FIG. 6, there is shown an enlarged plan view of one side of the centrifuge rotor shown partially broken away in section. FIG. 6 shows the one-piece plastic or aluminum rotor 46 with its inner retainer means 52 having an elongated hole to securely hold the tube 26 in position. The number 72 designates a dimension line representing the difference between the rubber cushion 56 and the outer retainer means 54, showing that only a small portion of the outer end of the tube 26 must be inserted into the outer retainer means 54. Dimension line 74 shows the elongated hole present in the inner retainer means 52, which securely holds the tube 26 in position under centrifuge conditions.

Figure 7:
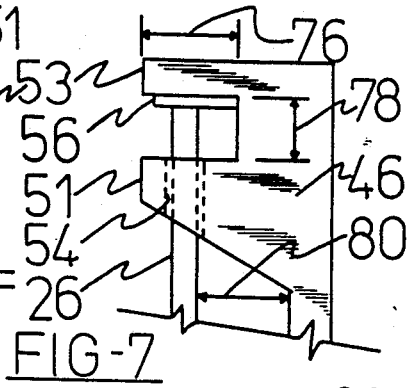
FIG. 7 is a partial elevation view, taken through line 7—7 of FIG. 6.

FIG. 7 is a partial elevation view, taken through line 7—7 of FIG. 6, showing in greater detail how the tube 26 is inserted into outer retainer means 54 and the tube 26 is held securely in place under raised central surface 51. Dimension line 76 represents the width of the area where the tube 26 is positioned and dimension line 78 represents the length of the tube 26 positioned past outer retainer means 54 and against rubber cushion 56. Dimension line 80 represents the distance between the tube 26 and the one-piece plastic or aluminum tube holder 46 which is necessary to provide finger clearance for the operator's hand in placing the tubes 26 in the centrifuge rotor.

Figure 8:
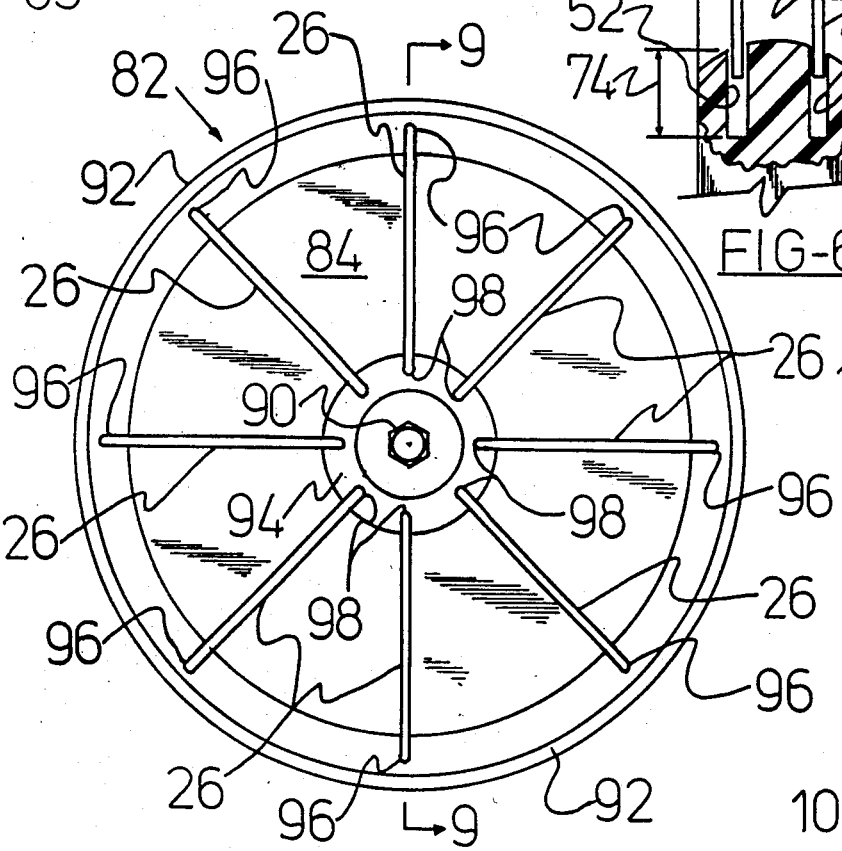
FIG. 8 is a top plan view of a modification of applicant's device.

Referring now to FIG. 8, there is shown a top plan view of a modification of applicant's centrifuge rotor, shown generally by the numeral 82. Applicant's modified centrifuge rotor 82 comprises a circular plate 84 having an outer tube retainer means 92 and an inner tube retainer means 94 wherein outer holes 96 are positioned circumferentially around the outer tube retainer means 92 and inner holes 98 are positioned circumferentially around inner tube retainer means 94. Bolt 90 is used for securing the applicant's modified centrifuge rotor to an existing apparatus.

Figure 9:
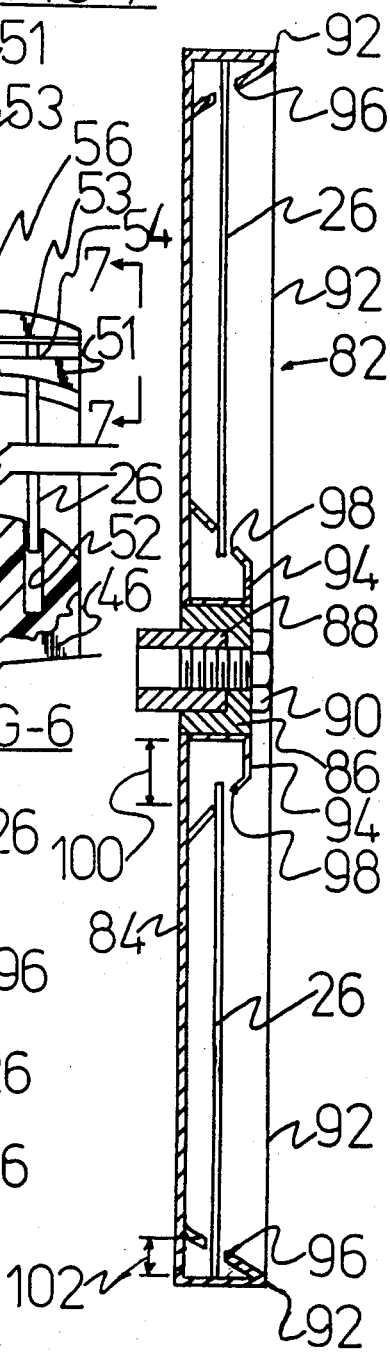
FIG. 9 is a cross-sectional view, taken through line 9—9 of FIG. 8, showing in greater detail a modified form of the invention.

Referring now to FIG. 9, there is shown a cross-sectional view, taken along line 9—9 of FIG. 8, showing applicant's modified centrifuge rotor 82. As explained with reference to FIG. 8, outer tube retainer means 92 has an outer hole 96, and inner tube retainer means 94 has an inner hole 98. Dimension line 100 represents the elongated length of the space in the inner tube retainer means 94 and dimension line 102 represents the shortened length of the space in the outer tube retainer means 92. At the end of the inner tube retainer means 94, there is a bushing 86 which carries a shaft 88, shaft 88 holds bolt 90 for positioning applicant's modified centrifuge rotor in an existing centrifuge apparatus.

From the foregoing, it can be seen that there has been accomplished by the applicant's invention all of the objects and advantages of the invention. A centrifuge rotor and apparatus for the determination of whole blood micro-hematocrits for in vitro diagnostic use has been invented, wherein centrifugal force holds the tubes in position and neither central lateral support for the tubes nor a separate cover to hold the tubes in place is required when the rotor and apparatus is used.

The inner retainer means 52 with it's elongated hole formed to the dimension length shown by the numeral 74 is longer than the outer retainer means 54 formed in the raised central surface 51. This allows the tubes 26 to be inserted at the inner end into the inner retainer means 52 and then slid outwardly into the outer retainer means 54. In the preferred embodiment, the length 74 of the inner retainer means in the form of the elongated hole would be approximately 0.5 inches while the dimension 72 would be approximately 0.25 inches. When the applicant's novel centrifuge rotor spins, the tubes 26 are held securely in place by centrifugal force acting in conjunction with the inner retainer means 52 and the outer retainer means 54 with their elongated holes.

In removing the tubes 26 after centrifuging, the tubes 26 are slid inwardly towards the center of the device within the inner retainer means 52 along the elongated hole (dimension 74) until the outer end 58 of the tubes 26 clears the outer retainer means 54 along the dimension 72. Thereafter, the tubes 26 can be removed from applicant's novel device.

In the modified form of the invention shown in FIGS. 8 and 9, the preferred length of the spaces 100 and 102 would be similar to the lengths 74 and 72 of the preferred embodiment. Because of the novel construction of the applicant's device in its various forms, the use of the novel inner and outer retainer means holds the tubes 26 securely in place in conjunction with centrifugal force during centrifuging and eliminates the need for a separate cover of the types shown in FIGS. 1A and 2A to retain the tubes in place.

This novel feature also permits faster and more safe loading of the delicate glass tubes 26 with accidental operator error virtually eliminated.

Nevertheless, variations in the structure of the invention and the arrangement of the various parts is within the spirit and scope of the applicant's invention. The embodiments given have been given only by way of illustration and the applicant is not to be limited to the embodiments shown and described.

Having described my invention, I claim:

1. A centrifuge rotor for use in blood analysis for separating red blood cells from blood plasma used with a tube having an inside and an outside with at least one end of the tube sealed with sealing means, the tube containing blood which is subjected to rotary action, comprising:

(a) a base;

(b) at least two first tube retainer means fixedly attached to the base;

(c) at least two second tube retainer means fixedly attached to the base;

(d) an elongated hole in at least two of the tube retainer means for securely positioning the tube in place; and (e) whereby the centrifuge rotor is rotated and the red blood cells are separated from the blood plasma, the first and second retainer means serving to securely hold the tube containing the blood in place during centrifuging thereby eliminating the use of a separate cover to retain the tube in place.

2. The centrifuge rotor as defined in claim 1 wherein the centrifuge rotor is one piece molded plastic.

3. The centrifuge rotor as defined in claim 1 wherein the centrifuge rotor is metal.

4. The centrifuge rotor as defined in claim 1 further comprising:

(f) a cushion means fixedly attached to at least two of the tube retainer means to hold the sealing means of the tube in place, thereby securing the blood in the tube.

5. The centrifuge rotor as defined in claim 1 wherein the elongated hole in at least two of the tube retainer means is in at least two of the first tube retainer means.

6. The centrifuge rotor as defined in claim 1 wherein the elongated hole in at least two of the tube retainer means is in both the first and second tube retainer means,

7. The centrifuge rotor as defined in claim 1 wherein the base is in a circular configuration having a plurality of first tube retainer means fixedly attached to the base and having a plurality of second tube retainer means fixedly attached to the base.

8. A centrifuge apparatus for use in blood analysis for separating red blood cells from blood plasma used with a tube having an inside and an outside with at least one end of the tube sealed with sealing means, the tube containing blood which is subjected to rotary action, comprising:

(a) a case having an inner divider;

(b) a motor fixedly attached to the case, the motor having a shaft and the shaft positioned through the inner divider of the case;

(c) a centrifuge rotor positioned within the case, the centrifuge rotor having a base, at least two first tube retainer means fixedly attached to the base, at least two second tube retainer means fixedly attached to the base, an elongated hole in at least two of the tube retainer means for securely positioning the tube in place;

(d) means for attaching the centrifuge rotor to the motor; and (e) whereby the centrifuge rotor is rotated and the red blood cells are separated from the blood plasma, the first and second retainer means serving to securely hold the tube containing the blood in place during centrifuging thereby eliminating the use of a separate cover to retain the tube in place.

9. The centrifuge apparatus as defined in claim 8 wherein the centrifuge rotor is one piece molded plastic.

10. The centrifuge apparatus as defined in claim 8 wherein thc centrifuge rotor is metal.

11. The centrifuge apparatus as defined in claim 8 further comprising:

(f) a cushion means, fixedly attached to at least two of the tube retainer means of the centrifuge rotor to hold the sealing means of the tube in place, thereby securing the blood in the tube.

12. The centrifuge apparatus as defined in claim 8 wherein the elongated hole in at least two of the tube retainer means of the centrifuge rotor is in at least two of the first tube retainer means of the centrifuge rotor.

13. The centrifuge apparatus as defined in claim 8 wherein the elongated hole in at least two of the tube retainer means of the centrifuge rotor is in both the first and second tube retainer means.

14. The centrifuge apparatus as defined in claim 8 wherein the base of the centrifuge rotor is in a circular configuration having a plurality of first tube retainer means fixedly attached to the base of the centrifuge rotor and having a plurality of second tube retainer means fixedly attached to the base of the centrifuge rotor.

15. In a centrifuge rotor for use in blood analysis for separating red blood cells from blood plasma used with a tube having an inside and an outside with at least one end of the tube sealed with sealing means, the tube containing blood which is subjected to rotary action of the type comprising a base; at least two first tube retainer means fixedly attached to the base; at least two second tube retainer means fixedly attached to the base; an elongated hole in at least two of the tube retainer means for securely holding the tube in place, the improvement comprising:

at least two holes being positioned at two points along two circumferential lines being spaced longitudinally from each other, the holes having an inner and outer point of contact with the tube whereby the tube is suspended at two separate points and a long trough is not needed to hold the tube in place.

16. The centrifuge rotor as defined in claim 15 further comprising:

a cushion means fixedly attached to at least two of the tube retainer means to hold the sealing means of the tube in place, thereby securing the blood in the tube.

17. The centrifuge rotor as defined in claim 15 wherein the elongated hole in at least two of the tube retainer means is in at least two of the first tube retainer means.

18. The centrifuge rotor as defined in claim 15 wherein the elongated hole in at least two of the tube retainer means is in both the first and second tube retainer means.

* * * * *